US005669207A

United States Patent [19]

Hull

[11] Patent Number: 5,669,207

[45] Date of Patent: Sep. 23, 1997

[54] METHOD FOR TACKLESS PACKAGING OF HOT MELT ADHESIVE

[75] Inventor: Mark Hull, Marine On The St. Croix, Minn.

[73] Assignee: H.B. Fuller Licensing & Financing, Inc., St. Paul, Minn.

[21] Appl. No.: 494,623

[22] Filed: Jun. 23, 1995

[51] Int. Cl.[6] ..... B65B 55/13

[52] U.S. Cl. ..... 53/440; 53/127

[58] Field of Search ..... 53/122, 127, 440, 53/450, 550, 551, 553

[56] References Cited

U.S. PATENT DOCUMENTS

| | | | |
|---|---|---|---|
| 2,762,504 | 9/1956 | Sparks et al. | 206/84 |
| 3,469,363 | 9/1969 | Berckmoes | 53/127 |
| 3,564,808 | 2/1971 | Kent | 53/127 |
| 3,720,037 | 3/1973 | Jones | 53/127 |
| 3,807,193 | 4/1974 | McKenney et al. | 53/127 |
| 3,987,602 | 10/1976 | Stahl | 53/127 |
| 4,054,632 | 10/1977 | Franke | 264/145 |
| 4,306,657 | 12/1981 | Levy | 206/447 |
| 4,748,796 | 6/1988 | Viel | 53/411 |
| 4,755,245 | 7/1988 | Viel | 156/227 |
| 5,074,104 | 12/1991 | Desjonqueres et al. | 53/551 |
| 5,257,491 | 11/1993 | Rouyer et al. | 53/428 |
| 5,307,608 | 5/1994 | Muir et al. | 53/440 |
| 5,373,682 | 12/1994 | Hatfield et al. | 53/440 |
| 5,401,455 | 3/1995 | Hatfield | 264/255 |

FOREIGN PATENT DOCUMENTS

| | | |
|---|---|---|
| 2 544 653 | 4/1983 | France . |
| 2 544 654 | 4/1983 | France . |
| 2 601 616 | 7/1986 | France . |
| 2 248 046 | 9/1972 | Germany . |
| 36 25 358 | 7/1986 | Germany . |
| 86 28 513 U | 10/1986 | Germany . |
| 87 10 132 U | 7/1987 | Germany . |
| 48-103635 | 12/1973 | Japan . |
| WO 94/13451 | 6/1994 | WIPO . |

*Primary Examiner*—John Sipos
*Assistant Examiner*—Gene L. Kim
*Attorney, Agent, or Firm*—Nancy N. Quan; Carolyn A. Fischer

[57] ABSTRACT

A method of packaging thermoplastic hot melt adhesive compositions in a continuous process. The process is especially suited for hot melt pressure sensitive adhesives to provide convenient handling of such. The process includes the steps of: dispensing a thermoplastic composition into a hollow sleeve of thermoplastic film, wherein said film is submerged in a heat sink bath; sealing the molten thermoplastic composition filled composition; allowing the molten thermoplastic composition to cool and solidify while submerged in the heat sink bath. An apparatus for practicing the process includes: a means for providing a hollow sleeve of thermoplastic film; a dispensing means for filling said hollow sleeve of thermoplastic film with a thermoplastic composition; a heat sink bath adjacent to said dispensing means such that the hollow sleeve of thermoplastic film is submerged in said heat sink bath while being filled; and a means for conveying the filled sleeve of thermoplastic film beneath the surface of the heat sink bath until said filled sleeve has substantially solidified.

2 Claims, 1 Drawing Sheet

METHOD FOR TACKLESS PACKAGING OF HOT MELT ADHESIVE

FIELD OF THE INVENTION

The present invention relates to an apparatus and a method for the continuous packaging of thermoplastic compositions, particularly hot melt adhesive compositions. More specifically it relates to an apparatus and a method for continuous packaging of thermoplastic pressure sensitive compositions by means of dispensing a flowable thermoplastic composition into a hollow sleeve of thermoplastic film.

DESCRIPTION OF THE ART

Hot melt adhesives which are generally applied while in the molten or liquid state are solid at room temperature. Typically, these adhesives are provided in the form of blocks and because of the nature of these materials, particularly the pressure sensitive hot melts, there are problems associated with handling and packaging them. The solid adhesive blocks not only stick or adhere to hands or mechanical handling devices and to each other, but they also pick up dirt and other contaminants. Additionally, certain applications which required high tack formulations result in blocks that will deform or cold flow unless supported during shipment. The need and advantages for providing tackless or non-blocking hot melt adhesives are apparent and various ways of accomplishing this have been developed. References pertaining to such techniques include:

JP 48-103635 published Dec. 25, 1973;

FR 2,544,653 published Oct. 26, 1984;

US 4,748,796 issued Jun. 12, 1988;

US 4,755,245 issued Jul. 5, 1988;

FR 2,601,616 published Oct. 22, 1988;

DE 31 38 222;

DE 32 34 065;

DE 36 25 348;

DE 22 48 046; and

US 5,257,491.

SUMMARY OF THE INVENTION

The present invention is directed to a method of packaging thermoplastic compositions in a continuous process, the corresponding packaged thermoplastic composition, and an apparatus thereof. The process is especially suited for pressure sensitive hot melt adhesive to provide convenient handling of such.

The applicants have found that when hot melt adhesive is poured in its molten state into a thermally conductive mold cavity lined with plastic packaging film or directly into a hollow sleeve of thermoplastic film that is in contact with a heat sink and then allowed to solidify, the adhesive is fused to some extent into the film resulting in a non-blocking adhesive package which will melt rapidly in the melt pot and will not cause a buildup of undesirable plastic residue even after extended periods of time. Thus, the intermolecular transfer of one or more of the hot melt components into the contact surface of the plastic film allows some mixing or compatibilizing of the film and the hot melt, thereby improving the opportunity for more complete mixing of the hot melt and film when remelting of the packaged hot melt occurs. The method provides an air-tight package allowing no air to be entrapped therein. The presence of entrapped air in prior packages has been blamed for a variety of problems including incomplete melting and blending of the packaging material into the adhesive whereby the packaging material floats on the surface of the hot melt and/or adheres to the walls of the melt pot.

Alternatively, the hot melt can be poured into a film having a much higher softening point than the hot melt adhesive. Such method is preferably used for bulk manufacturing as a low cost, reduced waste substitute for drums. Currently, for high volume users, pressure sensitive adhesives are commonly provided in disposable drums. In order to insure that fibers from the drums do not contaminate the adhesive, the interior surface of the drums are highly calendered or release coated, substantially increasing the cost of such drums. The applicants anticipate manufacturing a bulk cartridge of adhesive as an alternative to drums. During use, the cartridge of adhesive is suspended above the melt pot. Heat is applied to the outside surface of the package at a temperature below the softening point of the film but above the softening point of the adhesive. As the hot melt adhesive softens at the outer surface, the slug of adhesive descends into the melt pot. The exterior thermoplastic can then be recycled or disposed of.

Regardless of the melting point of the film, the method provides the benefit that the package itself is air-tight allowing no air to be entrapped therein. The presence of entrapped air in prior packages has been blamed for a variety of problems including incomplete melting and blending of the packaging material into the adhesive whereby the packaging material floats on the surface of the hot melt and/or adheres to the walls of the melt pot.

The inventive process comprises the steps of:

a. dispensing a thermoplastic composition into a hollow sleeve of thermoplastic film, wherein said film is submerged in a heat sink bath;

b. sealing the molten thermoplastic composition filled composition;

c. allowing the molten thermoplastic composition to cool and solidify while submerged in the heat sink bath.

The inventive apparatus comprises:

a. a means for providing a hollow sleeve of thermoplastic film;

b. a dispensing means for filling said hollow sleeve of thermoplastic film with a thermoplastic composition;

c. a heat sink bath adjacent to said dispensing means such that the hollow sleeve of thermoplastic film is submerged in said heat sink bath while being filled;

d. a means for conveying the filled sleeve of thermoplastic film beneath the surface of the heat sink bath until said filled sleeve has substantially solidified.

DETAILED DESCRIPTION OF THE INVENTION

Figure 1A:
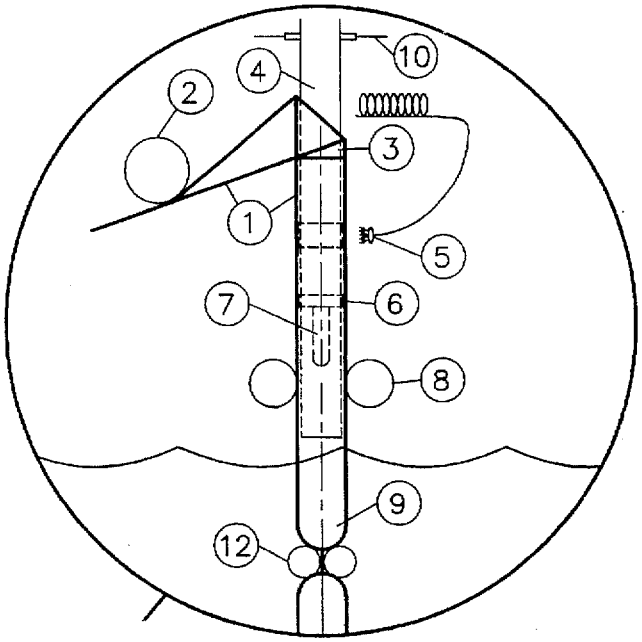
FIG. 1A an enlarged side view of the area encircled in FIG. 1.
Figure 1:
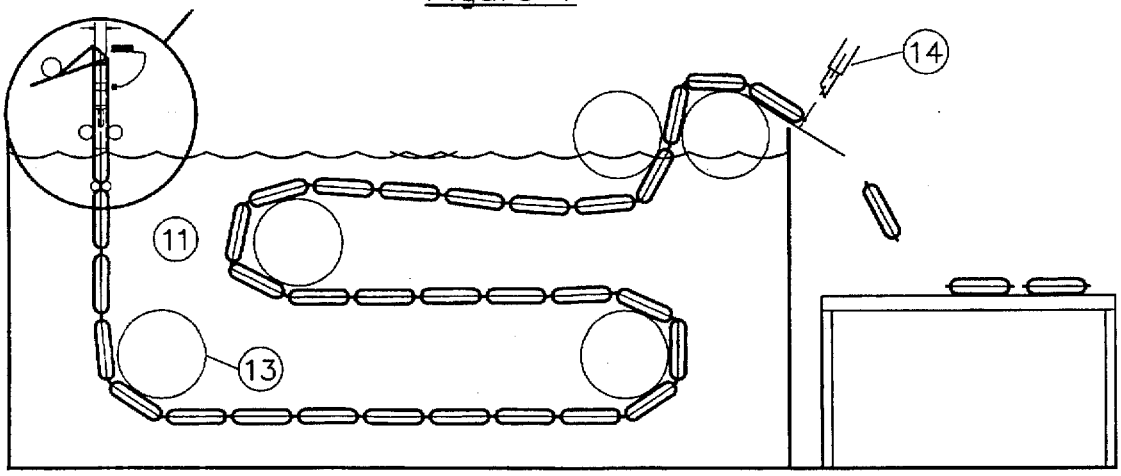
FIG. 1 depicts a side view of the method and apparatus of the present invention.

A preferred embodiment of the method and apparatus of the invention described herein is illustrated in FIGS. 1 and 1A. In the Figures, the plastic film (1) is passed through a series of idler rollers (2) which smooths the film and controls the tension across the web. The film is then threaded into a film folder (3) which folds the film and forms a lap seal around a one to four inch diameter fill pipe of mandrel (4).

The lap seal is sealed with hot air (5), induction sealing or ultrasonic welding and then may be further sprayed with cooling air to set the seal. Alternatively, the film could be made in-line by any suitable film forming process rather than be provide as a finished good on a roll.

After the seal has set, the tubular film is carried along the exterior of the fill pipe preferably using a series of spreader rings (6), film guide(s) (7) and drive wheels (8) until it reaches the end of the fill pipe, at which point the molten hot melt adhesive, pumped from a remote holding container through the mandrel enters the cylindrical plastic type (9).

The molten adhesive is generally poured or pumped into the plastic film cylinder at a temperature at which the molten adhesive exhibits a viscosity of 1,000 to 200,000, preferably 10,000 to 50,000 cps. This temperature will generally vary from about 110° to about 150° C. depending upon the particular adhesive. After filling, the adhesive cartridges, either individually or in a connected series, are further cooled to ambient temperature prior to bulk packaging. The latter cooling may be done by air or may be hastened by submerging the cartridge in chilled water or another refrigerant medium such as liquid or gaseous nitrogen, compressed carbon dioxide or the like.

Since the adhesive is pumped or poured continuously through the mandrel into the plastic film cylinder, it is possible to void and then cut the continuous filled tube into individual cartridges at virtually any desired length. In general, the individual cartridges are produced in a variety of sizes ranging from about three inches to 18 inches in length and varying in weight, depending on length, from about 0.5 to 5 pounds. Substantially larger sizes can also be employed with higher melting films as described below.

If desired, in order to maintain the desired molten viscosity, the fill pipe may be insulated or jacketed as with double walls and filled with inlet and outlet ports (10) through which heated water, steam or mixtures thereof may be circulated, so as to prevent premature cooling of the molten adhesive in the mandrel and melting of the plastic film on the mandrel. The double wall construction also facilitates complete cleaning and purging of the mandrel after the filling operation is completed.

During filling, the tubular package is submerged in a heat sink bath containing water (11) or other refrigerant medium. The heat sink is critical to the success of the method of the present invention and may comprise any means which will effectively and rapidly remove or absorb the excess heat from the entire surface of the film which is in contact with the molten hot melt adhesive composition so as to prevent the temperature of the film from exceeding its melting point even though the molten hot melt adhesive temperature is higher than the film melting temperature. Preferably the heat sink is provided as a water bath or other refrigerant means such as chilled glycol, liquid or gaseous nitrogen, compressed carbon dioxide or the like. The buoyancy of the heat sink bath supports the film during filling preventing stretching and tearing allowing the use of lower film thicknesses. Other means of providing a heat sink are disclosed in Hatfield, U.S. Pat. No. 5,373,682 incorporated herein by reference. It will be recognized that while the term "submersion in a heat sink bath" is utilizied herein, the invention also contemplates carrying out the entire filling operation in a cooled environment as in the presence of liquid nitrogen.

Subsequently the adhesive filled tube is passed through voider rolls (12) which crimp or pinch the continuous filled cylinder into smaller cartridge sized segments and which are set so as to assure the proper cartridge length. The linked cartridges are conveyed (13) beneath the surface of the heat sink bath until the package is sufficiently cooled so that the packaged adhesive forms a self-seal formed at the voided portions. For manufacturing bulk adhesive cartridges (in excess of 10 pounds), the cartridges may need to be further supported during cooling to prevent deformation. The cartridge packages may then be cut at the voided area using a conventional cutter (14), water jet or a heated knife or wire and subsequently cooled to room temperature. Alternatively, the voided but uncut cartridge segments, still attached in serial form may be cooled and cut thereafter or supplied to the end use in a linked cartridge form.

The cooling to room temperature may be accomplished entirely under ambient conditions, in a chilled air environment or may be hastened by submersion of the cartridges into a bath of cooled water, glycol, liquid nitrogen or the like.

The resultant individually packaged hot melt adhesive cartridges can be stored, handled, and used without any problems of the individual blocks sticking together, adhering to other objects, or becoming contaminated even if exposed to increased pressure and/or temperature. When it is desired to ultimately utilize the adhesive, the entire wrapped cartridge is added to the melt pot. As an advantage of the present method, the fact that the adhesive is poured or pumped into plastic or film cylinder in its molten form creates some degree of fusion between the adhesive and the film. Because of this fusion, very little additional energy is required to melt and blend the film into the adhesive itself. Further, the absence of any entrapped air results in a homogeneous melting of the adhesive with no plastic film undesirably separating from the wrapped adhesive and floating to the surface and/or sides of the melting pot.

Alternatively, the hot melt can be dispensed into a film sleeve having a much higher softening point than the hot melt adhesive. Such method is preferably used for bulk manufacturing as a low cost, reduced waste substitute for drums. During use, the cartridge of adhesive is suspended above the melt pot. Heat is applied to the outside surface of the package at a temperature below the softening point of the film but above the softening point of the adhesive. As the hot melt adhesive softens at the outer surface, the slug of adhesive descends into the melt pot. The exterior thermoplastic film sleeve can then be recycled or disposed of. The cartridges utilized in this manner may be of substantially larger size, for instance 8–20 pounds (about 1–2.5 gallons volume), or even as high as 450 pounds (about 55 gallons) if a very high tensile strength film, such as a polyester is used. Such larger size packages can be prepared with a water bath heat sink so that the buoyancy of the adhesive can be utilized to reduce stress on the film while the adhesive mass is filled and cooled.

The packaged hot melt adhesive cartridge may, of course, additionally be packaged in a second outer container to further reduce its exposure to the environment, moisture or other contaminants. The secondary wrapping would then be removed by conventional procedures prior to utilization of the hot melt adhesive.

The Thermoplastic Composition

The method of the present invention is adaptable to the packaging of virtually any type of hot melt adhesive composition. It is especially adapted to the packaging of thermoplastic or thermosetting pressure sensitive adhesives where the handling problems are-most severe. The method disclosed herein may be used to package hot melt adhesive prepared from polymers and copolymers of synthetic resins, rubbers, polyethylene, polypropylene, polyurethane, acrylics, vinyl acetate, ethylene vinyl acetate and polyvinyl alcohol. More specific examples include hot melt adhesives prepared from the following:

a. rubber polymers such as block copolymers of monovinyl aromatic hydrocarbons and conjugated diene, e.g., styrene- butadiene, styrene-butadiene-styrene, styrene-isoprene-styrene, styrene-ethylene-butylene-styrene, and styrene-ethylene propylene- styrene;
b. ethylene-vinyl acetate polymers, other ethylene esters and copolymers, e.g., ethylene methacrylate, ethylene n-butyl acrylate and ethylene acrylic acid;
c. polyolefins such as polyethylene and polypropylene;
d. polyvinyl acetate and random copolymers thereof;
e. polyacrylates;
f. polyamides;
g. polyesters;
h. polyvinyl alcohols and copolymers thereof;
i. polyurethanes;
j. polystyrenes;
k. polyepoxides;
l. graft copolymers of vinyl monomers and polyalkylene oxide polymers and;
m. aldehyde containing resins such as phenol-aldehyde, urea- aldehyde, melamine-aldehyde and the like.

The method of the present invention is also useful for water sensitive thermoplastic materials. Water sensitive thermoplastic materials are gaining wider acceptance as companies desire to manufacture compostable, recyclable, flushable and biodegradable disposable products, the need for easily handled packaging of such materials is also becoming increasingly important.

Water sensitivity is incorporated into disposable products with the use of various hydrophilic, water soluble, and water dispersable materials, some of which are truly thermoplastic while other are thermally stable additives and modifiers. Such water sensitive thermoplastic materials may be present as polymers, tackifiers, plasticizers, fillers etc., alone or in combination with other hydrophobic or hydrophilic materials. Water sensitive materials include polyamides, polyethyloxazaline, PVP, PVPA, polyvinyl alcohol, polyesters such as those manufactured by Eastman Chemical Company, polymethylvinylether, as well as starch and cellulosic esters.

Water sensitive thermoplastic materials mentioned above are useful as a raw material in a variety of applications such as, but not limited to, the manufacture of nonwovens, elastomeric materials, adhesives, food containers, as well as for producing breathable, biodegradable, and moisture-impermeable barrier films.

The present invention provides an economical, convenient handling, packaging method for all such materials for any use and is not limited to the packaging of hot melt adhesives.

Most often such adhesives are formulated with tackifying resins in order to improve adhesion and introduce tack into the adhesive. Such resins include, among other materials, (a) natural and modified resins, (b) polyterpene resins, (c) phenolic modified hydrocarbon resins, (d) coumarone-indene resins, (e) aliphatic and aromatic petroleum hydrocarbon resins, (f) phthalate esters and (g) hydrogenated hydrocarbons, hydrogenated rosins, and hydrogenated rosin esters.

Desirable optional ingredients include diluents, e.g., liquid polybutene or polypropylene, petroleum waxes such as paraffin and microcrystalline waxes, polyethylene greases, hydrogenated animal, fish and vegetable fats, mineral oil and synthetic waxes such as hydrocarbon oils such as naphthionic or paraffinic mineral oils.

Other optional additives may include stabilizers, antioxidants, colorants and fillers. The selection of components and amounts as wells as the preparation thereof are well known in the art and described in the literature.

The Thermoplastic Film

The thermoplastic film into which the molten adhesive is poured may be any film which is meltable together with the adhesive composition and blendable into said molten adhesive and which will not deleteriously affect the properties of the adhesive composition with blended therewith. For manufacturing bulk thermoplastic cartridges, the film may either be blendable into the molten adhesive composition without deleteriously affecting the properties or the film may have a softening point higher than the hot melt adhesive. When a higher softening point film is used, the film materials is not intended to be added to the melt pot. Suitable thermoplastic materials include ethylene based polymers such as ethylene/vinyl acetate, ethylene acrylate, ethylene methacrylate, ethylene methyl acrylate, ethylene methyl methacrylate, high and low density polyethylene, polyethylene blends and chemically modified polyethylene, copolymers of ethylene and C 1-6 mono- or diunsaturated monomers, polyamides, polybutadiene rubber, polybutylene terephthalate, etc.; thermoplastic polycarbonates, atactic poly-alpha-olefins, including atactic polypropylene; thermoplastic polyacrylamides, polyacrylonitrile, copolymers of acrylonitrile and other monomers such as butadiene, styrene, etc., polymethyl pentene, polyphenylene sulfide, aromatic polyurethanes, styrene-acrylonitrile, acrylonitrile-butadiene-styrene, styrene-butadiene rubbers, polyethylene terephthalate, acrylonitrile-butadiene-styrene elastomers, polyphenylene sulfide as well as polyvinyl aromatic-rubber block copolymers.

The films may, if desired contain antioxidants for enhanced stability as well as other optional components such as fatty amides or other processing aids, anti-stats, stabilizers, plasticizer, dyes, perfumes, fillers, and the like.

If the thermoplastic composition to be packaged is water sensitive, preferably the film is also water sensitive, but not reactive. Water sensitive thermoplastic film may be used so long as the heat sink bath does not contain water. However, a film material lacking water sensitivity may also be used serving a dual purpose of protecting the thermoplastic composition from moisture and water as well as providing a convenient means of handling such.

Where the film is intended to be added to the melt pot the specific thermoplastic film utilized will depend, in large part, on the composition and melting point of the thermoplastic composition being packaged, with the softening point of the film generally being less than about 125° C. More preferably, the film should have a sharp melting point, indicative by a high melt index relative to other film having about the same softening point. Suitable film for most thermoplastic compositions are thermoplastic films of low density polyethylene or polyethylene vinyl acetate wherein the amount of vinyl acetate is 1 to 10% preferably 3 to 5%, by weight. Preferred are such films having a melt flow index of 0.4 to 10.0, a softening point of 100° C. to 120° C. and a specific gravity of 0.88 to 0.96. One example of these films is available commercially from Quantum under the trade name of Petrothene NA-420. Most preferred, the film should have a melt viscosity substantially the same as the thermoplastic composition. For best results during usage of the packaged thermoplastic composition, it is preferred that the specific gravity of the packaging film be about the same as the specific gravity of the molten hot melt adhesive.

The thickness of the film utilized generally varies between about 0.1 mil to 5 mil, preferably 0.5 mil to 4 mil. Films thicker than 5 mil may be useful for very large volume cartridges, for instance 55 gallon drum size cartridges. The thickness of the particular film also varies depending upon the temperature at which the molten adhesive is pumped or poured into the plastic film cylinder. The particular viscosity at which the adhesive can be introduced into the plastic film cylinder will vary depending on a variety of factors including pumping capacity of the pump, the strength of then plastic film and the like viscosities in the range 1,000 to 200,000 cps, preferably 2,000 to 100,000 may be utilized. The most preferred viscosity of the adhesive which is to be packaged in accordance with the invention is between 10,000 and 50,000 cps. It will be recognized that the temperature at which an adhesive composition will exhibit this viscosity range will vary from one adhesive to another. In the case of adhesives which obtain their viscosity within the temperature range of 110° to 130° C., film thicknesses of about 1.25 mil are preferred; while for adhesives which exhibit this viscosity at temperatures of 130 to 150° C., films of about 1.5 mil are preferred. However, the applicants anticipate lower thickness films will be suitable when the film sleeve is filled below the surface of the heat sink bath.

It is further preferred that the thermoplastic film comprise not more than about 1.5% by weight of the total adhesive mass and that it optimally vary from 0.2 to 1.0% by weight of the mass in order to prevent under dilution of the adhesive properties.

We claim:

1. A method for using a hot melt adhesive comprising the steps of:

a. suspending a thermoplastic composition above a melt pot, said thermoplastic composition being substantially surrounded by a plastic film having an interior and exterior surface, said interior surface being in contact with a thermoplastic composition, said film becoming molten at a temperature higher than the thermoplastic composition;

b. heating the exterior of said film until said thermoplastic composition in contact with the interior surface of said film becomes sufficiently molten;

c. separating said exterior film from said thermoplastic composition after said thermoplastic composition becomes molten; and d. allowing said thermoplastic composition to descend into said melt pot.

2. A method for using a hot melt adhesive comprising the steps of:

a. providing a thermoplastic composition adjacent to a melt pot, said thermoplastic composition being substantially surrounded by a plastic film having an interior and exterior surface, said interior surface being in contact with a thermoplastic composition, said film becoming molten at a temperature higher than the thermoplastic composition;

b. heating the exterior of said film until said thermoplastic composition in contact with the interior surface of said film becomes sufficiently molten;

c. separating said exterior film from said thermoplastic composition after said thermoplastic composition becomes molten; and d. transferring said thermoplastic composition into said melt pot.

* * * * *